US006899249B2

(12) United States Patent
Sanders et al.

(10) Patent No.: US 6,899,249 B2
(45) Date of Patent: May 31, 2005

(54) TRAY FOR STORING AND TRANSPORTING PRODUCTS

(75) Inventors: Craig Sanders, Tres Pinos, CA (US); Toby Richard David Wingfield, Mansfield, TX (US); Leah Marie Reynolds, Atlanta, GA (US)

(73) Assignee: Fresh Advantage, Inc., Grand Prairie, TX (US)

( * ) Notice: Subject to any disclaimer, the term of this patent is extended or adjusted under 35 U.S.C. 154(b) by 0 days.

(21) Appl. No.: 10/281,825

(22) Filed: Oct. 28, 2002

(65) Prior Publication Data

US 2003/0141307 A1 Jul. 31, 2003

Related U.S. Application Data

(60) Provisional application No. 60/330,644, filed on Oct. 26, 2001.

(51) Int. Cl.[7] ..... B65D 1/42
(52) U.S. Cl. ..... 220/608; 220/606
(58) Field of Search ..... 220/508, 608, 220/609, 606, 605, 604

(56) References Cited

U.S. PATENT DOCUMENTS

| | | | | |
|---|---|---|---|---|
| 3,950,289 A | | 4/1976 | D'Amato et al. | 260/23 |
| 4,001,443 A | | 1/1977 | Dave | 426/106 |
| 4,486,552 A | | 12/1984 | Niemann | 523/169 |
| 4,830,863 A | | 5/1989 | Jones | 426/118 |
| 4,956,209 A | | 9/1990 | Isaka et al. | 428/35 |
| 5,353,985 A | * | 10/1994 | Nageli et al. | 229/123.1 |
| 5,523,136 A | | 6/1996 | Fischer et al. | 428/35 |
| 5,609,293 A | | 3/1997 | Wu et al. | 229/3 |
| 5,730,311 A | | 3/1998 | Curtis | 220/371 |
| 5,747,082 A | | 5/1998 | Floyd et al. | 426/109 |
| 5,807,630 A | | 9/1998 | Christie et al. | 428/323 |
| 5,908,133 A | * | 6/1999 | Luburic et al. | 220/572 |
| 5,958,319 A | | 9/1999 | Brant | 264/177 |
| 5,962,092 A | | 10/1999 | Kuo et al. | 428/34 |
| 6,033,758 A | | 3/2000 | Kocher et al. | 428/138 |
| 6,085,930 A | | 7/2000 | Curtis | 220/371 |
| 6,149,053 A | * | 11/2000 | Chatterton et al. | 229/407 |
| 6,190,710 B1 | | 2/2001 | Nir et al. | 426/106 |
| 6,232,402 B1 | | 5/2001 | Demeuse | 525/191 |
| 6,333,096 B1 | | 12/2001 | Rodgers et al. | 428/213 |
| 6,348,271 B1 | | 2/2002 | Nakata et al. | 428/500 |
| 6,395,071 B1 | | 5/2002 | Niijima et al. | 96/6 |
| 6,441,340 B1 | | 8/2002 | Varriano-Marston | 219/121 |
| 6,461,702 B2 | | 10/2002 | Gong | 428/36 |
| 6,619,501 B2 | * | 9/2003 | Hayes et al. | 220/608 |

* cited by examiner

*Primary Examiner*—Stephen Castellano
(74) *Attorney, Agent, or Firm*—Locke Liddell & Sapp

(57) ABSTRACT

A tray for storing and transporting products that are desirably kept separate from any liquid that may be present. The tray is made up of a base with a number of sidewalls extending up from the edges of the base. Preferably the sidewalls have an outwardly directed lip to which a suitable cover can be attached. The base of the tray is divided into a plurality of islands that cover the majority of the base by a plurality of intersecting channels. The width of the channels is sufficiently narrow to allow the product to span the channels and be supported by the islands. In some cases, a liquid permeable sheet may have to be placed over the channels to support products that cannot span even narrow channels. The collective volume of the channels is large enough to accept and contain all of the liquid that is likely to be present in the tray during use. In this way the liquid is kept separate and apart from the product contained in the tray.

19 Claims, 2 Drawing Sheets

TRAY FOR STORING AND TRANSPORTING PRODUCTS

CROSS REFERENCE TO RELATED APPLICATIONS

This Nonprovisional application is based in part upon and claims priority to the Provisional Patent Application No. 60/330,644 entitled "Tray for Storing and Transporting Products," filed Oct. 26, 2001 by Craig Sanders and Toby Wingfield.

BACKGROUND OF THE INVENTION

1. Field of the Invention

This invention relates generally to trays for storing and transporting products and, more particularly, to trays for storing and transporting food products, preferably fresh produce, that can benefit from being kept away from liquids exuded from the produce during storage and transport.

2. Description of Related Art

It is known to those skilled in the art that certain products, such as cut up or sliced produce, deteriorates when in contact with liquid during storage and transport. In the case of cut up produce the liquid is generally juice that exudes from the produce itself. In other cases, the liquid may be water that condenses on the product or interior of the packaging during storage and transport. This deterioration substantially reduces the shelf life of the product, such as the allowable time between cutting of the produce and utilization thereof by the consumer.

Attempts have been made to improve the shelf life of such products by packaging them in containers that are equipped with one or more absorbents. The container also would have some means to cause the liquid exuded from the cut produce to be absorbed by the absorbent. In this way, the produce is kept dry, thereby increasing its shelf life.

The use of absorbents in the packaging has a number of shortcomings. The use of an absorbent will increase the cost of the packaging. This additional cost will result in either decreased profits or increased price of the products to the consumer. In addition, the packaging material must be specially designed to accommodate the absorbent. Finally, the absorbent used must be compatible with the product as well as comply with any governmental regulations that may apply, such as when the product is sliced produce. This may necessitate a number of absorbents be available to ensure compatibility with the product being shipped. Therefore, there remains a need for a container for the packing and shipping of products such as cut produce that does not require the presence of an absorbent and yet maintains the cut produce and the liquid exuded therefrom separate and apart from each other.

SUMMARY OF THE INVENTION

A tray for storing and transporting products, particularly produce, that need to be kept separate from any liquid that may be present. The tray is composed of a base with walls extending up from all edges of the base. Preferably the walls have an outwardly directed lip to which a suitable cover can be attached if desired. The walls are connected to each other at the corners as well as to the base to form a receptacle for the products. The base of the tray contains a plurality of islands that cover the majority of the base. Separating the islands are a plurality of intersecting channels. The width of the channels is sufficiently narrow so products being transported span the channels and are supported by the islands. In some cases, it is necessary for a liquid permeable material to cover the channels to assist in supporting products that cannot span the width of even narrow channels. The collective volume of the channels is large enough to accept and contain all of the liquid that is likely to be present in the tray during its use. In this way any liquid produced during use is separated and kept apart from the products.

BRIEF DESCRIPTION OF THE DRAWINGS

The apparatus of the invention is further described and explained in relation to the following figures wherein.

DETAILED DESCRIPTION OF THE PREFERRED EMBODIMENT

The following description will describe the structure and construction of the claimed tray in terms of a preferred embodiment that has a rectangular base and four sidewalls that extend upwards from the base. However, it will be understood by one skilled in the art that substantially any shape can be used for the base. For example, the base can have an arcuate single edge, such as a circle or ellipse. Then there would be a single sidewall that is positioned in an arcuate manner around the entire single edge and extending upwards from the base.

The tray is preferably made from high impact polystyrene. The material is also preferably transparent for marketing purposes. Alternatively, a molded or thermoformed polymeric material can be used. It is contemplated that other plastic or metal molding materials could be used so long as the material retains its shape while holding a substantial weight of product, particularly produce including fruits, vegetables, or a combination thereof, therein and is substantially inert to the product and the liquid that is likely to be found in the package, such as sliced tomatoes and their liquid exudates. The material must also have sufficient strength and rigidity to withstand the rigors of machine packing and transportation, including the stacking of several trays one on top of the other. If the material being stored and transported is a food product then the material should also be GRASS or preferably FDA approved. The preferred method of manufacture is through injection or compression molding. Vacuum forming can also be used but is not as desirable a method for this product. One of skill in the art will recognize that other methods of manufacturing can be utilized depending upon the material used.

Figure 1:
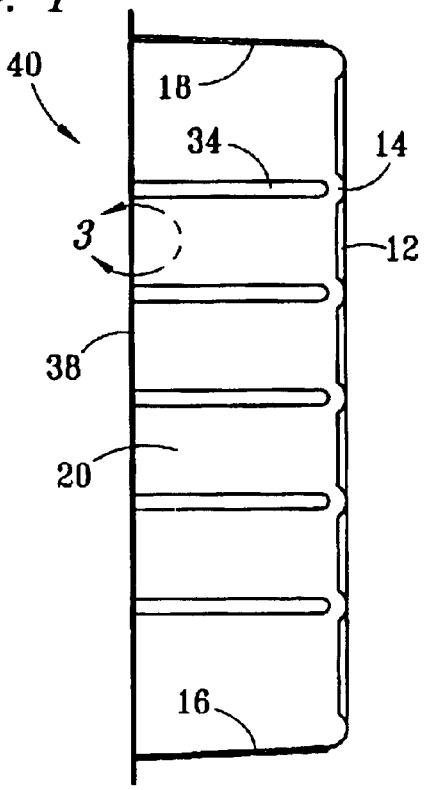
FIG. 1 is a side elevation view of a first preferred embodiment of the current invention.
Figure 3:
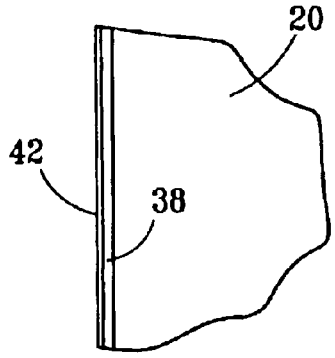
FIG. 3 is a close up view of the section of the tray in FIG. 1 surrounded by line 3—3.
Figure 2:
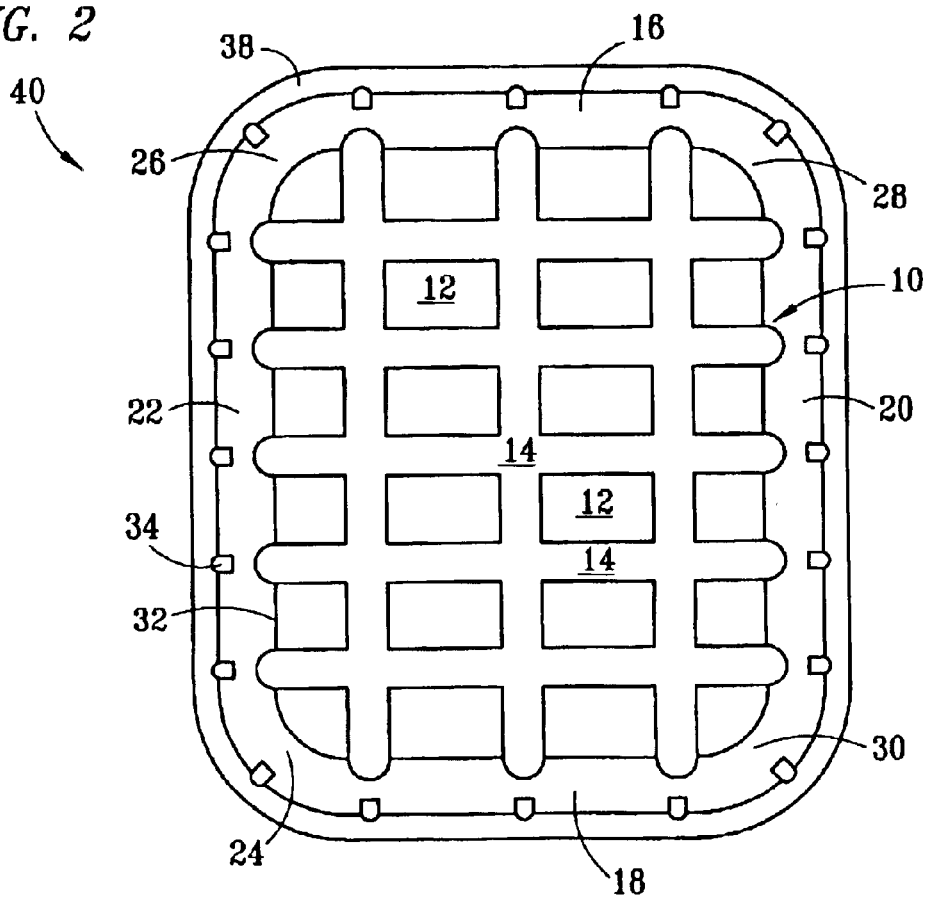
FIG. 2 is a bottom plan view of the first preferred embodiment of the current invention as shown in FIG. 1.

Referring to FIG. 2, tray 40 has a generally rectangular base 10. Base 10 is formed of a generally flat surface containing channels 14. Channels 14 are located in an intersecting pattern of parallel channels that form islands 12. As seen in FIG. 1, channels 14 are semicircular in cross section as seen in FIG. 1 and have a depth well below the surface of islands 12. The width of channels 14 is narrow enough so the product (not shown) can span the width of channels 14 and be supported by islands 12. The width and depth of channels 14 are also sized so that the total combined volume of channels 14 is sufficient to accept and hold all of the liquid that is expected to be present in tray 40 during its use. The shape and size of channels 14 are such that a number of trays 40 can be nested one on top of the other. Channels 14 are of a uniform size, shape and depth and are evenly spaced apart, although this does not necessary have to be the case.

It is contemplated that absorbent material may be placed in some or all of channels 14. Also, a liquid permeable material may be placed over some or all of the channels. This provides a larger surface to support products that may not be able to span even relatively narrow channels. The permeable layer may be a porous fabric, such as a woven or knitted fabric or a non-woven fabric such as felt. It also may be a liquid impermeable sheet that is perforated. The use of plural liquid permeable sheets is also contemplated.

Front wall 16 and rear wall 18 as well as sidewalls 20 and 22 extend upwardly from base 10. As shown in FIG. 1, front wall 16 and rear wall 18 are flared outward as they extend upward from base 10. Sidewalls 20 and 22 are likewise flared outward as they extend up from base 10. The outward flare of walls 16, 18, 20, and 22 serves to make it easier to remove tray 40 from the mold during manufacture. Walls 16, 18, 20 and 22 are suitably smooth and are joined to each other through arcuate corners 24, 26, 28 and 30 such that liquid runs smoothly down into channels 14 and there are no corners or crevices for liquid to accumulate. Walls 16, 18, 20 and 22 are connected to base 10 at seam 32 that runs around the edges of base 10. Alternatively, walls 16, 18, 20 and 22 can be connected to base 10 through arcuate corners to form a less abrupt juncture.

In order to strengthen walls 16, 18, 20, and 22, vertical supports 34 are added to the walls. Vertical supports 34 provide vertical and lateral stiffening of walls 16, 18, 20, and 22 and are located on the outer surface of walls 16, 18, 20, and 22 to minimize problems with removing the tray from the mold when it is made. Vertical supports 34 can also be located on the inside of the walls and still provide the desired structural stability to the tray. If vertical supports 34 are located on the inside of walls 16, 18 20, and 22, they should have a smooth transition into the lower wall portion so any liquid will easily move down into the base and not get caught up on the sidewall.

At the top of walls 16, 18, 20 and 22 is lip 38. Lip 38 is wide enough so cover 42 can adhere to lip 38 and cover tray 40. Cover 42 is a suitable film form material such as transparent polyethylene sheeting. Cover 42 can be formed as a multi-layer laminated or co-extruded sheet of two or more polymers where the layers either are different materials or are all composed of the same material. Most preferentially, cover 42 is a sheet comprising a laminate of linear low-density polyethylene (LLDPE) and oriented polypropylene (OPP). The polypropylene film may be flat extruded and then oriented on a tenter frame or it may be extruded as a tube and then expansion oriented as a "bubble."

The layers making up cover 42 can be mono-axially oriented or bi-axially oriented or multi-axially oriented in order to alter its strength and oxygen transmission (OTR) characteristics, as known to those of skill in the art. The OTR characteristics of cover 42 are significant and depend upon the product being transported and stored. For example, in the case of sliced tomatoes, a high OTR has been found to be desirable to maintain the freshness of the product.

Cover 42 is attached to lip 38 of tray 40 through heat-sealing. Cover 42 can also be attached to lip 38 by gluing, electrostatic attractions, or other methods known to those of skill in the art. Cover 42 may be further perforated or otherwise weakened in order to permit easy access to the interior of tray 40. Alternatively, cover 42 can be a relatively rigid material that either overlays tray 40 or hingedly connects to lip 38. In either case, at least a portion of cover 42 may laterally terminate in a locking mechanism that is adapted to mate with lip 38 so that cover 42 can be snapped into place on tray 40 through downward pressure, in a manner known to those of skill in the art.

Figure 4:
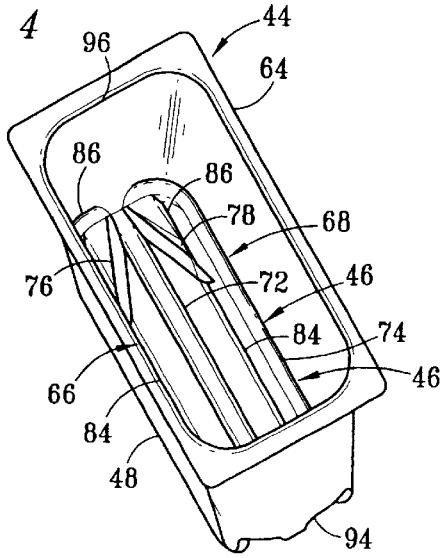
FIG. 4 is a perspective view of a second preferred embodiment of the current invention.
Figure 5:
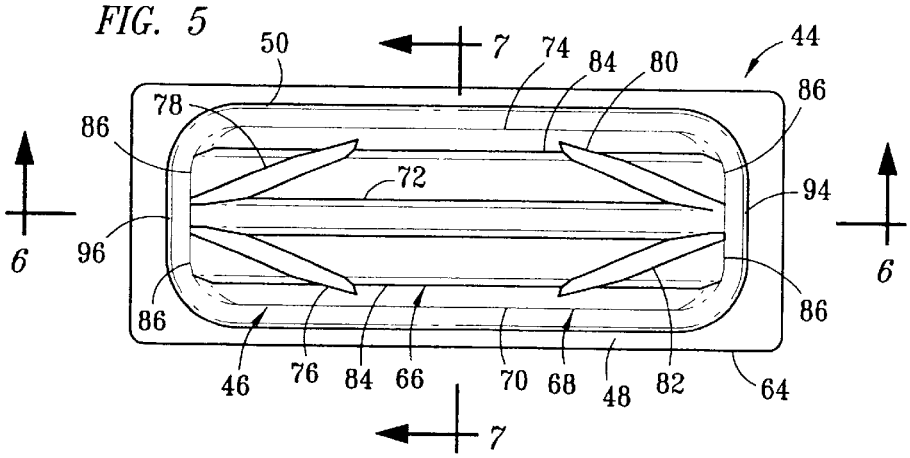
FIG. 5 is a top plan view of the second preferred embodiment.
Figure 6:
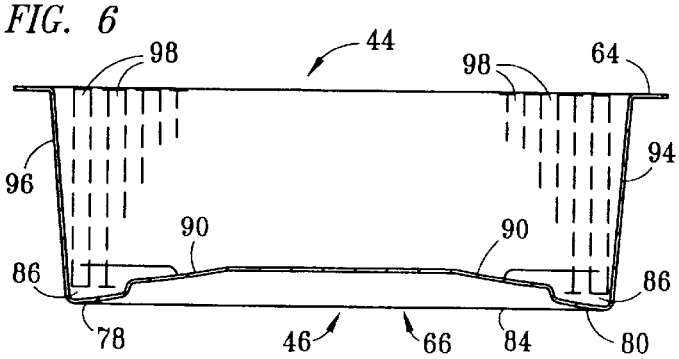
FIG. 6 is a cross-sectional view taken along line 6—6 in FIG. 5.
Figure 7:
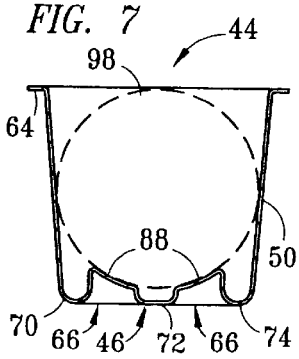
FIG. 7 is a cross sectional view taken along line 7—7 in FIG. 5.

A second preferred embodiment, depicted in FIGS. 4–7, is especially designed to hold sliced produce, such as tomatoes, onions, cucumbers, oranges, pineapple or the like, in an upright position. Referring to FIG. 4, tray 44 is integrally molded and generally made up of base 46, front wall 48, back wall 50, side walls 94 and 96, and channels 68 that define islands 66. Walls 48, 50, 94 and 96 are sufficiently smooth to allow liquid to flow down into channels 68 without getting caught in any corner or crevice and are flared outward as shown in FIGS. 6 and 7 to make it easier to remove tray 44 from the mold during manufacturing. Like in the previous embodiment, lip 64 provides a surface for any desired cover to be attached. FIGS. 6 and 7 illustrate in dashed outline a row of circular produce slices 98 disposed inside tray 44 during use.

As can be seen in FIG. 5, channels 68 are composed of parallel channels 70, 72 and 74 as well as cross channels 76, 78, 80 and 82. Parallel channels 70, 72, and 74 are parallel to each other and run the length of tray 44 with parallel channels 70 and 74 adjacent to front wall 48 and rear wall 50 respectively, and parallel channel 72 running down the middle of base 46 equally spaced from parallel channels 70 and 74. Channels 68 are all of an equal depth that gives channels 68 a total volume sufficient to accept and hold any liquid exuded from said produce slices during storage and transport. For sake of clarity, produce slices 98, shown in dashed outline in FIGS. 6–7, are not shown in FIG. 5.

Cross channels 76 and 82 angle obliquely from the respective ends of parallel channel 72 to parallel channel 70. Likewise cross channels 78 and 80 angle obliquely from the respective ends of parallel channel 72 to parallel channel 74. Cross channels 76, 78, 80, and 82 allow fluid communication between parallel channels 70, 72, and 74 and are angled so that produce slices 98 (FIGS. 6–7 can be held in an upright position on islands 66, perpendicular to parallel channels 70, 72, and 74 while ensuring that no slice will fall into cross channels 76, 78, 80, or 82.

Channels 68 define islands 66, which are made up of center islands 84 and end islands 86. FIG. 5 shows how islands 66 are aligned in two rows between parallel channels 70, 72 and 74. Center islands 84 and end islands 86 in each row are identical to each other except that center islands 84 are bounded on either side by cross channels 76 and 82, or cross channels 78 and 80, while end islands 86 are bounded by cross channels 76, 78, 80 or 82 on one end and sidewall 94 or 96, on the other end.

As shown in FIG. 7, center islands 84 and end islands 86 have arcuate top surfaces 88 that slope downwardly toward parallel channel 72. Arcuate top surfaces 88 on either side of parallel channel 72 are part of the circumference of the same circle. This allows a substantially circular product, such as produce slices 98 standing on edge, to be supported by arcuate top surfaces 88 while preventing the product from deforming or shifting more than desired. Arcuate top surfaces 88 are desirably sized so that produce slices 98 can be supported in a vertical configuration by islands 66 with every slice spanning parallel channel 72.

As seen in FIG. 6, center islands 84 have sloped surfaces 90 on either end. Sloping surfaces 90 are a result of the intersection of cross channels 78 and 80 with arcuate top surface 88. Arcuate top surface 88 gets higher as you go from parallel center channel 72 to parallel channel 74. Consequently, as cross channels 78 and 80 angle further toward parallel channel 74, more of arcuate top surface 88 is visible from the perspective shown in FIG. 6. This produces sloped surfaces 90 shown in FIG. 6.

The above descriptions of certain embodiments are made for the purposes of illustration only and are not intended to be limiting in any manner. Other alterations and modifications of the preferred embodiment will become apparent to those of ordinary skill in the art upon reading this disclosure, and it is intended that the scope of the invention disclosed herein be limited only by the broadest interpretation of the appended claims to which the inventors are legally entitled.

What is claimed is:

1. A tray for storing and transporting sliced produce comprising:

an elongate base;

upwardly extending walls surrounding the base;

the base comprising at least three longitudinal parallel channels intersected by a plurality of oblige, angular channels to define parallel first and second rows of islands disposed on opposite sides of a longitudinal channel;

the islands having arcuate top surfaces transverse to the parallel channels, with the arcuate too surfaces of the islands in the first and second rows defining segments from a common circle;

wherein said channels are narrow enough for said sliced produce to span said channels and be supported by said islands while standing on edge above the channels; and wherein said intersecting channels define a volume large enough to accept any liquid exuded by the sliced produce standing in said tray and contain said liquid apart from said produce.

2. The tray of claim 1 wherein said tray is a molded polymeric material.

3. The tray of claim 1 wherein said tray is a thermoformed polymeric material.

4. The tray of claim 1 wherein said tray is a molded metal material.

5. The tray of claim 1 wherein the walls have a top with a lip.

6. The tray of claim 5 further comprising a cover attachable to said lip.

7. The tray of claim 6 wherein said cover is a plastic film.

8. The tray of claim 6 wherein said cover is perforated or weakened to allow easy access to said products.

9. The tray of claim 5 further comprising a cover attached to said lip.

10. The tray of claim 1 wherein the sliced produce is selected from the group consisting of tomatoes, onions, cucumbers, oranges and pineapple.

11. The tray of claim 1 wherein said base is rectangular in shape.

12. The tray of claim 5 wherein said walls flare outwardly toward the top.

13. The tray of claim 1 wherein said walls are generally smooth.

14. The tray of claim 1 further comprising vertical supports in said walls.

15. The tray of claim 1 wherein adjacent walls are joined together at arcuate corners.

16. The tray of claim 1, wherein said channels have a semicircular cross section.

17. The tray of claim 1 comprising three longitudinal parallel channels and four angular channels each angular channel connecting two longitudinal parallel channels.

18. The tray of claim 1 wherein each row of islands is disposed between two longitudinal parallel channels.

19. The tray of claim 18 wherein said islands have an arcuate top surface to support produce slices having an arcuate outer surface.

* * * * *

UNITED STATES PATENT AND TRADEMARK OFFICE

CERTIFICATE OF CORRECTION

PATENT NO. : 6,899,249 B2
APPLICATION NO. : 10/281825
DATED : May 31, 2005
INVENTOR(S) : Craig Sanders et al.

It is certified that error appears in the above-identified patent and that said Letters Patent is hereby corrected as shown below:

Column 3
Line 44 insert comma after number 18.
"located on the inside of walls 16, 18, 20, and 22, they should"

Column 5
Line 29 "oblige" should be --oblique--.

Column 5
Line 34 "too" should be --top--.

Signed and Sealed this

Sixth Day of March, 2007

JON W. DUDAS
*Director of the United States Patent and Trademark Office*